United States Patent [19]

Cameron

[11] 4,340,145

[45] Jul. 20, 1982

[54] CADDY FOR GARMENT HANGERS

[76] Inventor: Anson W. Cameron, 3109 Walden. La., Wilmette, Ill. 60091

[21] Appl. No.: 170,190

[22] Filed: Jul. 18, 1980

[51] Int. Cl.[3] ..... A47H 13/00

[52] U.S. Cl. ..... 211/124; 211/7

[58] Field of Search ..... 211/124, 7, 105.1, 123, 211/105.3; 248/188.9, 353; 403/109, 359, 308, 377

[56] References Cited

U.S. PATENT DOCUMENTS

| | | | |
|---|---|---|---|
| 1,375,611 | 4/1921 | Schoell | 211/7 |
| 1,464,311 | 8/1923 | Eriksen | 211/124 |
| 2,858,995 | 11/1958 | Sarro | 211/123 X |
| 3,498,650 | 3/1970 | Stronge | 403/377 X |
| 3,868,906 | 3/1975 | Cameron | 211/124 X |
| 4,037,728 | 7/1977 | Cameron | 211/7 X |
| 4,079,840 | 3/1978 | Usner | 211/7 X |

*Primary Examiner*—Roy D. Frazier
*Assistant Examiner*—Robert W. Gibson, Jr.
*Attorney, Agent, or Firm*—Leydig, Voit, Osann, Mayer & Holt, Ltd.

[57] ABSTRACT

A caddy for garment hangers formed of a thin walled hollow tube with a pair of molded plastic end plugs of hollow cylindrical shape press fitted into the tube. The outwardly extending portions of the plugs have transverse through-openings. A hanger clamping member arranged parallel to the tube has, secured at its respective ends, for registering with the openings, a pair of latching members in the form of leaf springs each having a straight portion and a reversely bent end portion carrying a latch surface at the side thereof. Each reversely bent portion is laterally sprung so that the latch surface engages a land surface on the inner wall of the associated end plug when the clamping member is in an outwardly spaced hanger-receiving position and engages a land surface on the outer wall of the plug when the clamping member is in an inwardly pressed clamping position. Each end plug has a button-shaped projection at its outwardly extending end defining an annular recess for receiving and retaining a loop of rope for suspension during transport.

4 Claims, 11 Drawing Figures

CADDY FOR GARMENT HANGERS

In my prior U.S. Pat. No. 3,868,906 which issued Mar. 4, 1975 entitled Control and Handling of Garment Hangers there is disclosed an open-ended tube with a coextensive retainer strip having latching members at its ends. The latching members register with transverse receiving openings adjacent the respective ends of the tubes and which are formed by a punching operation.

The prior construction is intended primarily for the organized return of empty hangers. While the device is also usable for transporting hangers in the "loaded" condition, that is, with garments, the means for supporting the caddy in the loaded condition is not particularly satisfactory, either for suspension in a transport van or the like or from the standpoint of handling ease. Not only are the raw ends of the tube open and unprotected, to that extent providing a slight hazard to the user, but the open ends are obstructed by the respective latching members thereby precluding obtaining a good "grip" by a hook type suspension member. As a result, when the caddies are transported in loaded condition they risk being jostled onto the floor of the transport van when the van hits a bump or pot hole. Thus the garments may become wrinkled or soiled before they reach the point of sale.

The prior construction has also been found to offer manufacturing problems; for example, where the tubular member is made of plastic it is difficult or impossible to punch. Where the tubular member is formed of thin metal it is a problem to punch the necessary holes without locally flattening or otherwise deforming the tube so that a subsequent reforming step is required to re-establish the tubular profile. Some metals are particularly difficult to punch, as for example, stainless steel. Thus whether the tube is made of plastic or metal it is difficult, in the prior structure, to achieve a neat and workmanlike appearance.

It is, accordingly, an object of the present invention to provide an improved caddy for garment hangers which is particularly intended for transport of hangers in the "loaded" condition, that is, with garments thereon, and which insures safe and secure transport in a van in spite of a rough ride and striking of bumps and hollows. It is a related object to provide a caddy for transporting garment hangers in the loaded condition which is so constructed and so suspended as to enable the van to be packed to a density from 50 to 100 percent greater than that normally achieved resulting in substantial economies of transport and regardless of the shape or size of the garments, which may range all of the way from short blouses to long evening dresses.

It is another object of the invention to provide a caddy construction distinguished by a hollow tube which is simply cut to length without any further punching, machining, shaping or the like and fitted in its ends with end plugs of molded plastic providing a termination which is not only highly functional but attractive and finished in appearance.

More specifically it is an object to provide, as part of a caddy construction, an end plug which is easily pressed into the end of the hollow tube, in the manner of a cork into a bottle, for permanent retention therein, which includes molded-in openings for registering with latch members on a retainer strip, and which provides an enclosed end for mounting of suspension hardware defining an annular recess for engagement by a loop of rope or the like during transport.

It is an object related to the above to provide a hanger caddy construction which is highly economical enabling use of a low cost thin metal tube of seamed construction, end plugs which may be cheaply molded on a high production basis plus simple and inexpensive suspension fittings, all easily assembled together, with the assembly being so straight-forward as to permit usage of automatic assembling machines. In this connection it is an object of the invention to provide a caddy for garment hangers made up of a seamed tube and plastic end plugs in which the end plugs, by reason of keying to the tube, are automatically oriented with respect to one another.

Other objects and advantages of the invention will become apparent upon reading the attached detailed description and upon reference to the drawings in which.

While the invention has been described in connection with a preferred embodiment, it will be understood that I do not intend to be limited to the particular embodiment shown but intend, on the contrary, to cover the various alternative and equivalent constructions included within the spirit and scope of the appended claims.

Figure 1:
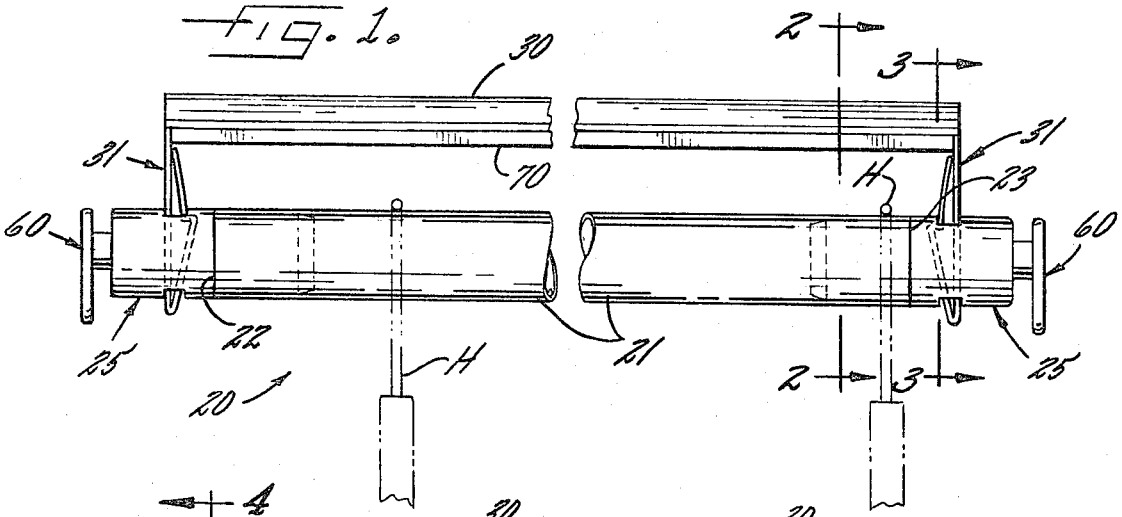
FIG. 1 is an elevational view of a caddy constructed in accordance with the present invention.
Figure 2:
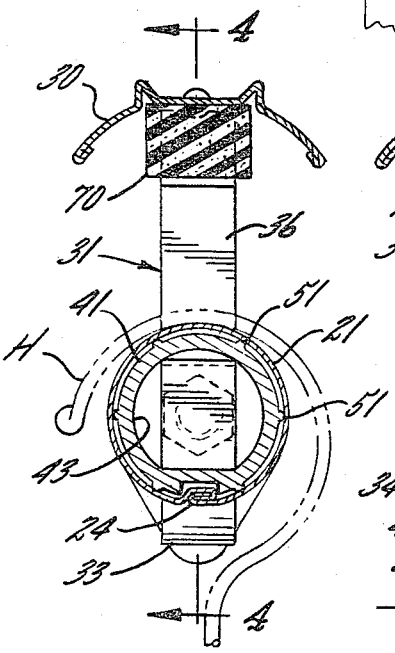
FIG. 2 is a vertical cross section taken along line 2—2 in FIG. 1.
Figure 3:
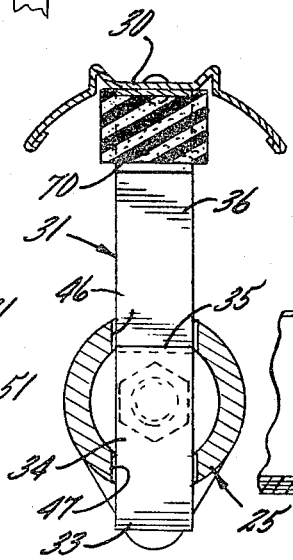
FIG. 3 is a vertical cross section taken along line 3—3 in FIG. 1.

Turning now to the drawings, a caddy for garment hangers, indicated generally at 20, includes a thin walled metal tube 21 having squared-off ends 22, 23. The tube may be of the seamed type having an internal longitudinally extending seam 24 (FIG. 2).

Fitted into the ends of the tube 21 are end plugs 25 to which more detailed reference will be made. For retaining garment hangers, having hooks H, on the tube, either in the loaded condition for transport or in the unloaded condition, a hanger clamping member 30 is provided having secured at right angles at the respective ends thereof, for example, by riveting, a pair of latching members 31. Each latching member is in the form of a flat leaf spring formed of suitable resilient metal having a straight body portion 32 reversely bent at 33 to define a laterally sprung end portion 34 having a latch surface 35 at its side. Preferably the reversely bent portion of each leaf spring extends beyond the latch surface and terminates adjacent the straight portion, as indicated at 36, to provide additional springing, thereby enabling use of lighter spring stock.

Figure 7:
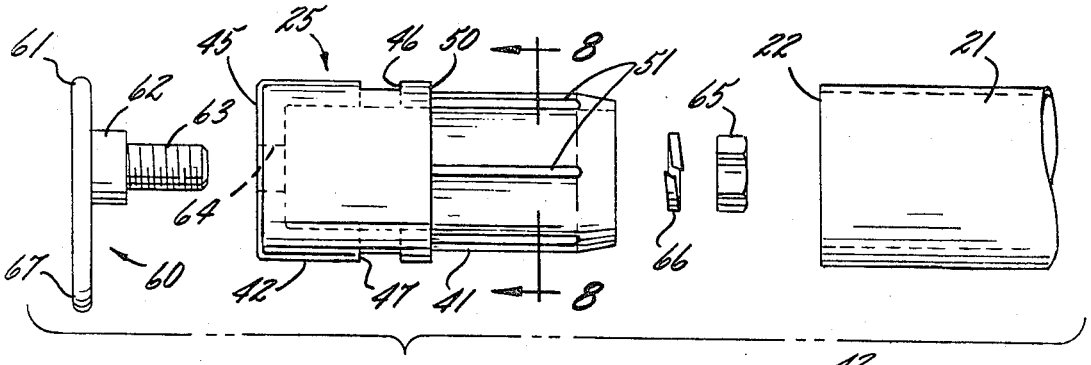
FIG. 7 is an exploded view showing the tube, end cap and associated hardware prior to assembly.

In accordance with the present invention each end plug 25 (FIG. 7) is of hollow cylindrical shape having an inner, or inserted, portion 41 and an outwardly extending portion 42 with a central hollow defined by an inner wall 43 and an outer wall 44 as well as an end wall 45.

Figure 6:
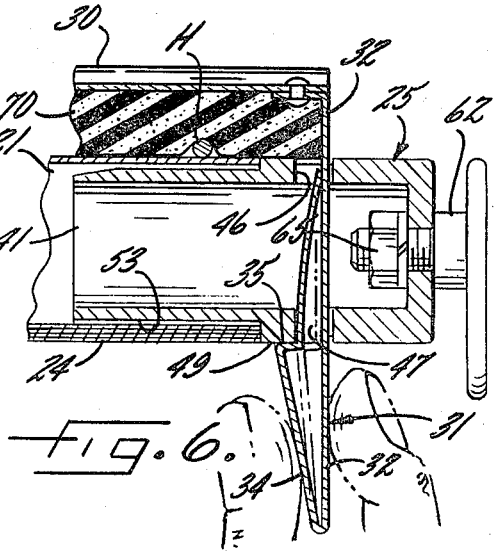
FIG. 6 is a fragmentary longitudinal section similar to FIG. 4 with the retainer in latched position prior to release.

Formed in the outwardly extending portion 42 of the plug are a pair of transversely aligned openings 46, 47 each dimensioned to receive and register with a latch member 31. For cooperating with the latch surface 35 on the latch member, the opening 46 has a land surface 48 on the inner wall of the associated end plug which is engaged (FIG. 4) when the clamping member 30 is in outwardly extended receiving position. Similarly, the opening 47 has a land surface 49 on the outer wall of the end plug engaged when the retaining member is in its inwardly pressed clamping position (FIG. 6).

The inserted portion 41 of the plug is slightly smaller in diameter than the portion 42 defining a shoulder 50 at the junction between them to positively limit the degree of insertion. The net radial extension of the shoulder is made substantially equal to the thickness of the metal forming the tube so that the tube is flush with the outwardly extending portion of the plug.

Figure 8:
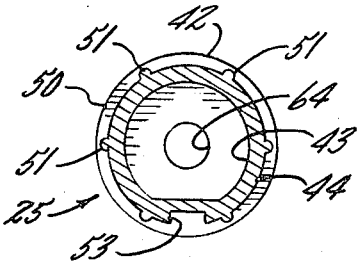
FIG. 8 is a cross section taken through the inserted portion of the end cap along line 8—8 in FIG. 7.

For the purpose of insuring an intimate press fit between the plug and the tube, the inserted portion of the plug is integrally formed with shallow projections peripherally spaced thereon. In the present embodiment the shallow projections are in the form of longitudinally extending ribs 51 which, as will be understood, make use of the elasticity of the tube wall in providing a tight joint. To insure that the end plugs at each end of the tube have their openings faced in the same direction, that is, oriented parallel to one another, the inserted portion of the plug has, molded along one side, a longitudinally extending groove 53 (FIG. 8) for keyed reception of the seam 24 of the tube.

In accordance with one of the aspects of the present invention, each end plug has a button-shaped axially oriented projection at its outwardly extending end defining an annular recess for receiving and retaining a supporting loop of rope for suspension during transport.

While such projection may be molded integrally with the end plug, it is preferred to make the projecting member as a separate piece of hardware receivable in an axial opening formed in the end wall 45 of the plug. Thus I provide a loop receiving member 60 (FIG. 7) having a button-shaped head 61 supported upon a pedestal 62 having a threaded shank 63. The shank is received in an axial opening 64 formed in the end wall of the plug and engaged, on the inner side of the end wall, by a nut 65 having a lock washer 66. The pedestal 62 defines an annular recess 68 (see FIG. 4). The recess extends through a complete circle, permitting the tube to be rotated about its axis while suspended. This enables the device to be loaded with the clamping member 30 hanging pendulously following which it is swung through 180 degrees and clamped to closed condition.

Figure 11:
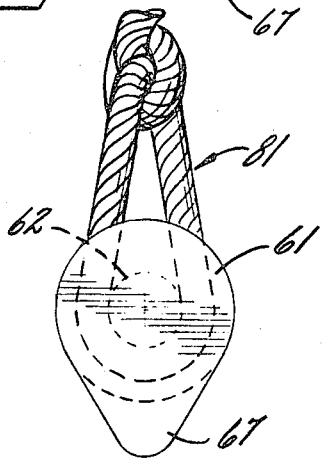
FIG. 11 is an end view of the structure in its supported condition.

The head 61 of the member 60 is, as shown in FIG. 11, preferably of "tear drop" shape having a pointed end 67 which is preferably downwardly oriented and which facilitates insertion of the button-shaped projection into a supporting loop.

For the purpose of preventing looseness or play between the hanger hooks H and the hook clamping member 30 when the latter is in clamped condition, and to accommodate hooks of different thickness, a strip of foam rubber or the like 70 is cemented to the underside of the retainer.

Figure 4:
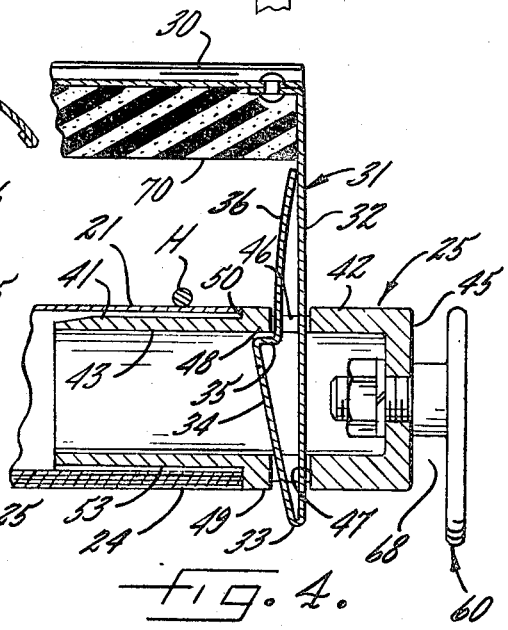
FIG. 4 is a fragmentary longitudinal section taken along line 4—4 in FIG. 2.
Figure 5:
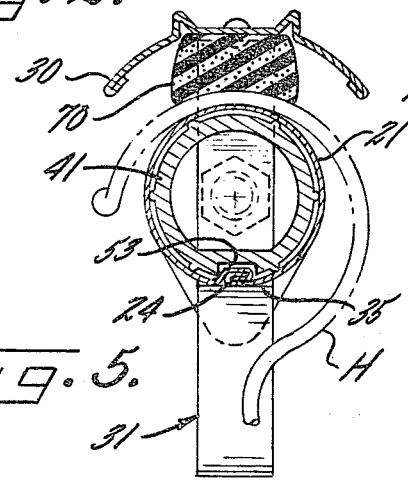
FIG. 5 is a cross sectional view similar to FIG. 2 but showing the retainer in closed and latched position.

It will be apparent that the parts of the device are not only simply formed but may be simply assembled. First the button-shaped receiving members 60 are secured to the respective end plugs by their associated nuts 65. Next the end plugs are pressed axially into their seated position with the grooves 53 thereof in keyed engagement with the internal seam 24 of the tube thereby automatically orienting the transverse openings in the plugs so that they are parallel to one another. Following this the clamping member 30 is snapped into position with the latch members 31 thereof entering the openings in the respective plugs. The open receiving position of the retaining member is illustrated in FIG. 4 where it will be noted that the latch surface 65 is opposite the land 48. Because of the outward springing of the portion 34 of the latch member, the clamping member is held securely captive to the tube. However, should disassembly become necessary, the extension 36 (see FIG. 4) of the resilient latch member may be pinched to retract the latch surface 35 from the land surface 48.

With the caddy temporarily supported, and after a plurality of garment hangers have been loaded onto the tube, the clamping member 30 is pressed inwardly into the clamping position illustrated in FIG. 6 in which the foam rubber strip bears resiliently against the hanger hooks and with the latch surface 35 latched below the land surface 49 on the tube. This locks the clamping member in position until intentionally released. Such intentional release is brought about by squeezing together the portions 32, 34 of the latch member so that the portion 34 moves from its "full line" to the "dot-dash" position thereby clearing the land 49 and allowing the clamping member to be retracted.

Figure 9:
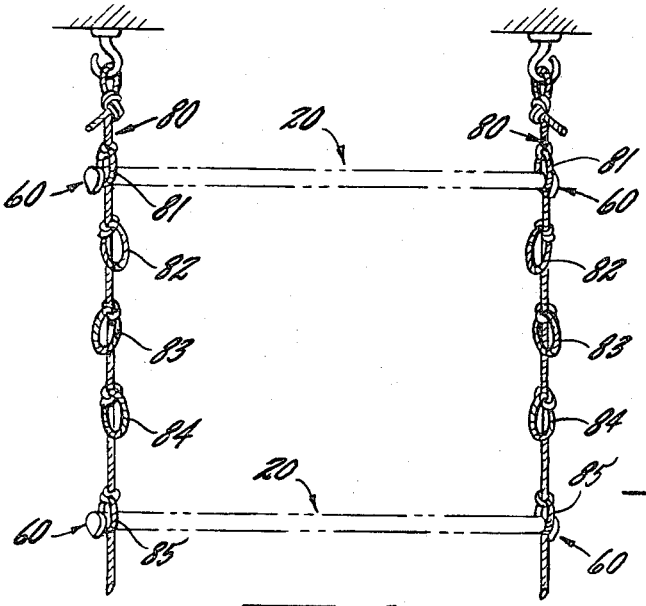
FIG. 9 shows the manner in which the caddies are transported in loaded condition in a transport van.
Figure 10:
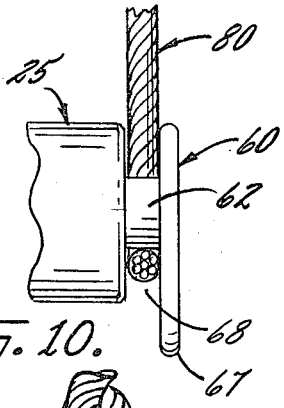
FIG. 10 shows the engagement of the end of a caddy by a supporting loop of rope.

In utilizing the above-described caddy in transporting of garments on hangers a caddy, loaded as described, is suspended upon a pair of ropes 80 having paired loops 81–85 (FIG. 9) inclusive. Each caddy is hung as high as possible on the ropes, for example, in the first set of loops 81, entering the pointed ends of the tear drop projections, button-like, into the pair of loops, so that each loop becomes firmly seated in the annular recess 68 (FIG. 10). In the event that the garments on the caddy are short, several other caddies may be supported upon the same set of ropes in lower positions as shown in FIG. 9, the height being chosen in any event such that the lowest load is clear of the floor.

It is found that the above construction not only provides secure retention of the hanger hooks but also secure retention of the caddies on the supporting ropes, with the result that the garments are safely supported regardless of the bumps or potholes which the transporting van may encounter. The vertical stacking of the caddies in the van enables high density loading so that a much larger pay load of garments may be transported each trip than has been possible heretofore.

The button-shaped projections also serve to provide secure support as the garments are conveyed on carts or trolley bars.

It will be apparent that the present construction offers an ease and economy of manufacture not possessed by the construction disclosed in my prior patent. The sections of tubing require simply a square cut at each end without any further piercing, forming or machining, thereby avoiding the problems associated with the piercing of thin-walled tubing. The end plugs may be injection molded in large quantity at extremely low cost and simply pressed in place using a suitable compression jig, with each end plug being automatically oriented by the seam in the tube. The resulting construction is multifunctional providing a smooth sliding fit between the latch members and the tube, a tight fit with respect to the tube and convenient, secure suspension while presenting an attractive and finished appearance, with no raw edges capable of causing injury.

While the caddies are particularly useful for transporting garments they are equally useful for return of the empty hangers in organized condition for re-loading at the source. The construction while simple and economical is inherently long-lived and each caddy may be used almost indefinitely without noticeable wear and tear.

What I claim is:

1. A caddy for garment hangers comprising, in combination, a thin walled hollow tube having a longitudinally extending internal bead, a pair of end plugs of hollow cylindrical shape fitted in the respective ends thereof, the end plugs having an inserted portion providing a press fit with respect to the tube and having an outwardly extending portion having a pair of transversely alined openings formed therein, each end plug having a shoulder midway along its length and which serves as a stop to limit the degree of insertion, the inserted portion of each end plug having a longitudinal groove to provide mated clearance for the bead on the tube and to insure that the end caps are oriented so that the openings therein face precisely in the same direction, a hanger clamping member extending between the openings parallel to the tube, the clamping member having rectangularly secured at the respective ends thereof and registering with the alined openings a pair of latching members in the form of leaf springs each having a straight portion and a reversely bent end portion carrying a latch surface at the side thereof, the reversely bent portions being laterally sprung so that each latch surface engages a land surface on the inner wall of the associated end plug when the clamping member is in an outwardly spaced hanger-receiving position and engages a land surface on the outer wall of the end plug when the clamping member is in an inwardly pressed clamping position.

2. A caddy for garment hangers comprising, in combination, a thin walled hollow tube having a longitudinal seam formed on the inner wall thereof, a pair of molded plastic end plugs fitted in the respective ends of the tube, each end plug being of hollow cylindrical shape having an inserted portion of reduced diameter with shallow projections peripherally spaced on the surface thereof providing a press fit with respect to the tube and having an outwardly extending portion with a pair of transversely alined openings formed therein, a hanger clamping member extending between the openings, the clamping member having rectangularly secured at the respective ends thereof and registering with the openings a pair of latching members in the form of leaf springs each having a straight portion and a reversely bent end portion carrying a latch surface at the side thereof, the reversely bent portions being laterally sprung so that each latch surface engages a land surface on the inner wall of associated end plug when the clamping member is in an outwardly spaced hanger-receiving position and engages a land surface on the outer wall of the end plug when the clamping member is in an inwardly pressed clamping position, the inserted portion of the plug having a longitudinal groove keyed to the seam on the inner wall of the tube thereby to insure that the openings in the end plugs are faced in the same direction, the end plugs each having a shoulder at the junction between the inserted portion and the outwardly extending portion for limiting the degree of insertion of the end plugs into bottomed condition on the tube.

3. The combination as claimed in claim 2 in which each end plug has a button-shaped axially oriented projection at its outwardly extending end defining an annular recess for receiving and retaining a supporting loop of rope for suspension during transport.

4. The combination as claimed in claim 1 or in claim 2 in which the reversely bent portion of each leaf spring extends beyond the latch surface and terminates adjacent the straight portion to provide additional springing.

* * * * *